US005467678A

United States Patent [19]

Stollenwerk

[11] Patent Number: 5,467,678

[45] Date of Patent: Nov. 21, 1995

[54] APPARATUS FOR AUTOMATICALLY APPLYING EQUALIZED PRESSURE TO A ROTARY CUTTING DIE

[76] Inventor: Josef A. Stollenwerk, 344 Spring Branch Dr., Canton, Ga. 30115

[21] Appl. No.: 192,713

[22] Filed: Feb. 7, 1994

Related U.S. Application Data

[63] Continuation-in-part of Ser. No. 129,871, Sep. 30, 1993, abandoned, and a continuation-in-part of Ser. No. 111,475, Aug. 25, 1993, abandoned.

[51] Int. Cl.[6] ..... B26D 1/62

[52] U.S. Cl. ..... 83/344; 83/346; 100/47; 100/170

[58] Field of Search ..... 83/13, 343, 344, 83/346, 348, 663; 100/47, 168, 170, 176

[56] References Cited

U.S. PATENT DOCUMENTS

| | | | |
|---|---|---|---|
| 2,267,380 | 12/1941 | Tyler | 100/170 X |
| 2,861,504 | 11/1958 | Kane | 100/170 X |
| 2,871,519 | 2/1959 | Flint et al. | 100/170 X |
| 3,101,636 | 8/1963 | Schultz | 100/47 X |
| 3,159,063 | 12/1964 | Fox | 100/170 X |
| 3,196,615 | 7/1965 | Kautz | 100/170 X |
| 4,455,903 | 6/1984 | Kesten | 83/346 |
| 4,507,996 | 4/1985 | Kesten | 83/344 |
| 4,638,934 | 1/1987 | Fram | 225/97 |
| 4,770,078 | 9/1988 | Gautier | 83/344 |
| 4,922,778 | 5/1990 | Nagai | 83/501 |
| 5,058,472 | 10/1991 | Kakko-Chiloff | 83/344 |
| 5,207,138 | 5/1993 | Sato et al. | 83/337 |

OTHER PUBLICATIONS

Hydraulic Pressure Gauging System, The Rotometrics Group, publication date unknown.

Dual Piston Hydra Screw—The Rotometrics Group, publication date unknown.

*Primary Examiner*—Richard K. Seidel

*Assistant Examiner*—Raymond D. Woods

*Attorney, Agent, or Firm*—Louis T. Isaf; James A. Witherspoon

[57] ABSTRACT

An equalizer assembly that integrates into the die cutting station of a press and comprises two hydraulic actuators, each of which interacts with one of the jackscrews of the press to create an internal hydraulic pressure. The internal pressure of a first of the hydraulic actuators corresponds to a loading force that is imparted upon the rotary cutting die proximate to a first end of the rotary cutting die, and the internal pressure of a second of the hydraulic actuators corresponds to a loading force that is imparted upon the rotary cutting die proximate to a second end of the rotary cutting die. The hydraulic actuators are in fluid communication with one another such that the hydraulic pressures therein are maintained substantially equal to define an overall system hydraulic pressure, and the hydraulic actuators are designed and arranged so that the loading forces generated thereby are substantially equal. Therefore, in response to loading forces of the jackscrews, whether equal or unequal, the equalizer functions to automatically apply equal loading forces to the opposite ends of a rotary cutting die, whereby the rotary cutting die is evenly loaded. A hydraulic pump functions to selectively increase the system hydraulic pressure and a pressure gauge monitors the system hydraulic pressure.

2 Claims, 6 Drawing Sheets

APPARATUS FOR AUTOMATICALLY APPLYING EQUALIZED PRESSURE TO A ROTARY CUTTING DIE

CROSS-REFERENCE TO RELATED APPLICATIONS

This application is a continuation-in-part of application Ser. No. 08/111,475, filed Aug. 25, 1993, and now abandoned and is a continuation-in-part of application Ser. No. 08/129,871, filed Sep. 30, 1993, and now abandoned.

BACKGROUND OF THE INVENTION

The present invention relates generally to the field of presses that include rollers, and, in its most preferred embodiments, to the field of methods and apparatus for applying pressure to rotary cutting dies.

Presses with rollers are well known and widely used. More particularly, well known and used are presses that include a die cutting station comprising a rotary cutting die that is adjacent to a rotary anvil. A nip is defined between the rotary cutting die and the anvil, and sheet-like product is drawn through the nip while pressure is applied to the rotary cutting die to cut the product. The rotary cutting die typically includes two ends which are mounted to the press frame. Pressure is applied proximate to each of the ends of the rotary cutting die by a pair of independent roller assemblies disposed above the rotary cutting die. The roller assemblies are attached to the underside of a pressure bar proximate to the opposite ends of the pressure bar. Pressure is typically applied to the pressure bar by two independent jackscrews that function as the force applying means of the press. The jackscrews are in threaded engagement with a bridge bar that is connected to the press frame and disposed above the pressure bar. In use, the jackscrews are threaded through the bridge bar so that their shanks engage and apply force to the top side of the pressure bar. Due to difficulties in adjusting the jackscrews equally and maintaining equal loading of the jackscrews, this conventional arrangement inherently results in situations where a greater force is applied to one end of the rotary cutting die than the other. This uneven loading results in an uneven pressure distribution between the rotary cutting die and the rotary anvil.

Rotary cutting dies are typically manufactured and maintained within close tolerances in an effort to insure that they can be used to generate quality products for a long period of time. Uneven loading will typically cause a rotary cutting die to cut unevenly and wear excessively or abnormally, causing the rotary cutting die to fall outside of acceptable tolerances prematurely. Thus, there is an incentive for maintaining even loading on a rotary cutting die, and efforts have been made to maintain such even loading. These efforts have included the development of devices for independently monitoring the load applied by each jackscrew of the pair of jackscrews. By monitoring the load applied by each jackscrew individually, a user can adjust the jackscrews so that each of the jackscrews applies an equal load. However, this has its limitations because, for example, a user is required to adjust the jackscrews in an iterative manner to obtain the equal loading of the proper magnitude. Such iterative adjusting can be time consuming. Additionally, as a press operates, the parts thereof often heat up and expand such that the loading of a rotary cutting die becomes uneven to a degree that jackscrew adjustment is necessary.

SUMMARY OF THE INVENTION

Briefly described, the present invention includes an pressure equalizer assembly that functions to automatically apply and maintain even loading of a rotary cutting die. More particularly, the equalizer assembly functions to automatically apply an equal amount of force proximate to the opposite ends of a rotary cutting die.

In accordance with the preferred embodiment, and the first and second alternate embodiments of the present invention, the equalizer assembly integrates into the die cutting station of a press and comprises two hydraulic actuators, each of which includes a cylinder with a piston operatively associated therewith. In general terms, each of the hydraulic actuators interacts with one jackscrew of the pair of jackscrews of the press and generates an internal pressure. The internal pressure of a first of the hydraulic actuators corresponds to a loading force that is imparted upon the rotary cutting die proximate to a first end of the rotary cutting die, and the internal pressure of a second of the hydraulic actuators corresponds to a loading force that is imparted upon the rotary cutting die proximate to the second end of the rotary cutting die. The hydraulic actuators are in fluid communication with one another such that the hydraulic pressures therein are maintained substantially equal to define an overall system hydraulic pressure. The hydraulic actuators are constructed and arranged such that when each is exposed to an equal hydraulic pressure, the loading forces generated thereby are substantially equal. Therefore, in response to loading forces of the jackscrews, whether equal or unequal, the equalizer assembly functions to automatically apply equal loading proximate to the opposite ends of a rotary cutting die, whereby the rotary cutting die is evenly loaded.

In accordance with the preferred embodiment, and the first and second alternate embodiments of the present invention, the fluid communication is maintained between the hydraulic actuators by tubing connected therebetween, and the equalizer assembly further includes a hydraulic pump in fluid communication with the tubing. The hydraulic pump functions to selectively increase and decrease the system hydraulic pressure. Therefore, the hydraulic pump functions to increase or decrease the output forces of the hydraulic operators independent of operation of the jackscrews. Only one adjustment is required to the hydraulic pump to adjust the loading forces applied proximate to the opposite ends of the rotary cutting die. In accordance with the preferred embodiment of the present invention, the hydraulic pump is constructed and arranged to provide more sensitive control over the system hydraulic pressure than is provided by operation of the jackscrews. Also, in accordance with the preferred and first and second alternate embodiments of the present invention, a pressure gauge is in fluid communication with the tubing to provide an indication of the system hydraulic pressure, and thereby an indirect indication of the amount of force applied to the rotary cutting die.

In accordance with the first preferred embodiment of the present invention, the equalizer assembly takes the place of a conventional pressure bar in the die cutting station of a press, and the equalizer assembly comprises a crossbar to which the hydraulic actuators are attached. The shanks of the jackscrews effectively engage the top of the crossbar and the pistons of the hydraulic actuators depend from the crossbar to apply, by way of rollers, loading force to the rotary cutting die. In accordance with the second alternate embodiment of the present invention, the equalizer assembly takes the place of a conventional bridge bar in the die cutting station of a press, and the equalizer assembly comprises a crossbar to which the hydraulic actuators are attached. The shanks of the jackscrews thread though the pistons of the hydraulic actuators and then engage the pressure bar, and rollers depending from the pressure bar apply loading force to the rotary cutting die.

It is therefore an object of the present invention to provide a method and apparatus for automatically applying equal pressure across a rotary cutting die.

Another object of the present invention is to prolong the life of rotary cutting dies.

Yet another object of the present invention is to simplify the process of achieving and maintaining even loading of a rotary cutting die.

Still another object of the present invention is to minimize the wasteful generation of defective products that results from the uneven loading of rotary cutting dies.

Still another object of the present invention is to decrease the amount of manpower required to operate a press that includes a die cutting station.

Other objects, features and advantages of the present invention will become apparent upon reading and understanding this specification, taken in conjunction with the accompanying drawings.

DETAILED DESCRIPTION OF SELECTED EMBODIMENTS

Figure 1:
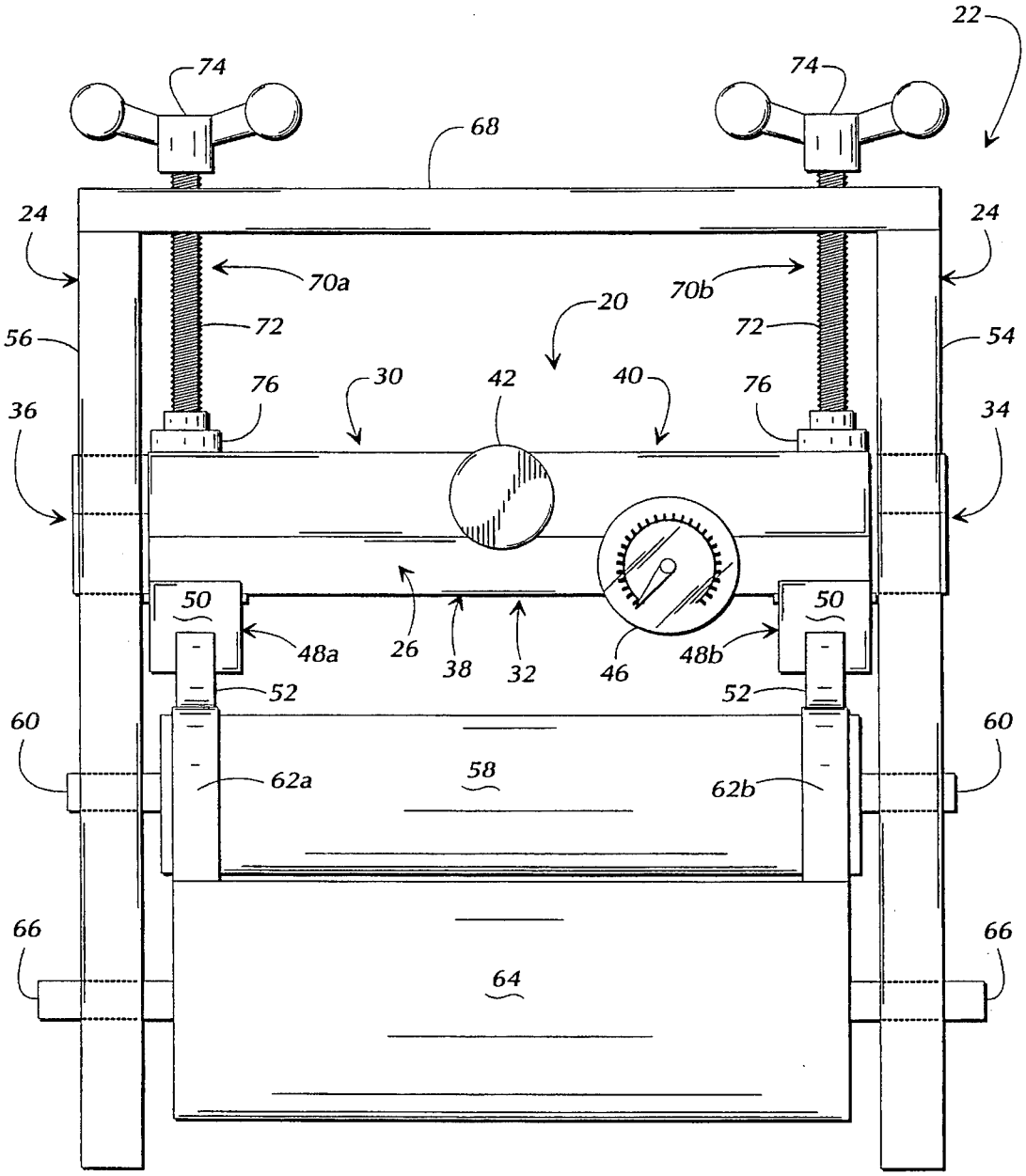
FIG. 1 is a front elevational view of an equalizer assembly mounted to the die cutting station of a press frame, in accordance with a first preferred embodiment of the present invention.

Referring now in greater detail to the drawings, in which like numerals represent like components throughout the several views, FIG. 1 is a front elevational view of an equalizer assembly 20 (referred to hereafter as the equalizer 20) mounted to the die cutting station 22 of a press frame 24, in accordance with a first preferred embodiment of the present invention. The equalizer 20 defines a front 26, top 30, bottom 32, right end 34, and left end 36. In accordance with the preferred embodiment of the present invention, the equalizer 20 comprises a crossbar 38 at the bottom 32 and a cover 40 at the top 30. The cover 40 partially covers the crossbar 38. The equalizer 20 further comprises, in the preferred embodiment, a pump handle 42 that is pan of a hydraulic pump 44 (FIGS. 2 and 8), a pressure gauge 46 extending from the front 26 of the equalizer 20, and a pair of trucks 48*a,b* depending from the bottom 32 of the equalizer 20. In accordance with the preferred embodiment, each truck 48 includes a chassis 50 and rollers 52.

As discussed in greater detail below, when the equalizer 20 is in use it is, in accordance with the preferred embodiment of the present invention, connected to the press frame 24 of a conventional die cutting station 22. In accordance with the preferred embodiment of the present invention, the equalizer 20 takes the place of a conventional pressure bar. The equalizer 20 is preferably shaped and sized to allow the equalizer to be installed in and removed from the cutting station 22 of a press frame 24 in substantially the same manner that a conventional pressure bar is installed in and removed from the cutting station 22. More particularly, end 34 of the equalizer 20 resides within a vertical slot defined between a pair of upright members that are part of the right side 54 of the press frame 24. Similarly, end 36 of the of the equalizer 20 resides within a vertical slot defined between a pair of upright members that are part of the left side 56 of the press frame 24. In accordance with the preferred embodiment of the present invention, the equalizer 20 is installed within the cutting station 22 above a rotary cutting die 58 that includes shafts 60 connected to the press frame 24 and annular bearers 62*a,b*. The rotary cutting die 58 typically defines cutting elements (not shown) thereon. Typically a rotary anvil 64 is connected by shafts 66 to the press frame 24 below the rotary cutting die and a bridge bar 68 spans between and is connected to the sides 54,56 of the press frame 24 above the equalizer 20. In accordance with the preferred embodiment, the equalizer 20 interacts with a pair of jackscrews 70*a,b* that each include threaded shanks 72 that extend through and threadedly engage the bridge bar 68. Each jackscrew 70 further includes a handle 74 and foot 76 at opposite ends.

Figure 2:
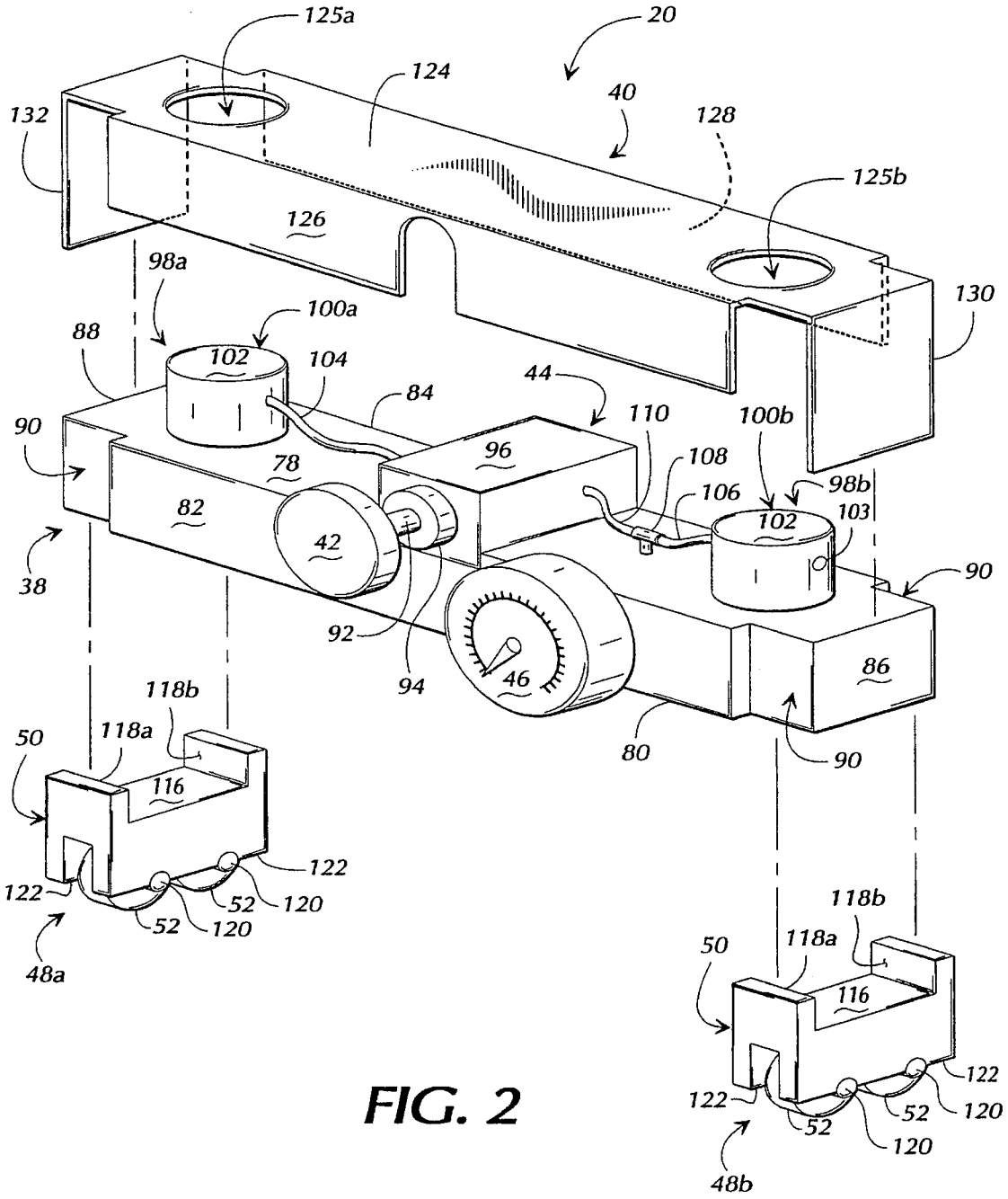
FIG. 2 is an isolated, partially exploded, front perspective view of the equalizer assembly of FIG. 1, in accordance with the preferred embodiment of the present invention.

FIG. 2 is an isolated, partially exploded, front perspective view of the equalizer 20, in accordance with the preferred embodiment of the present invention. In FIG. 2, the cover 40 is shown separated from and positioned above the crossbar 38, and the trucks 48*a,b* are shown separated from and positioned below the crossbar 38. The crossbar 38 includes a top 78, bottom 80, front 82, rear 84, right end 86, and left end 88. In accordance with the preferred embodiment of the present invention, each of the ends 86,88 define oppositely oriented indentations 90 (see also FIG. 3) that function to facilitate secure engagement of the equalizer 20 to the press frame 24 (FIG. 1). Referring momentarily also to FIG. 1, the indentations 90 accommodate the upright members that are part of the right side 54 and leer side 56 of the press frame 24 to facilitate secure engagement between the equalizer 20 and the press frame 24. The previously mentioned hydraulic pump 44 is, in accordance with the preferred embodiment, mounted to the top 78 of the crossbar 38, for example, by bolts (not shown). The hydraulic pump 44 comprises, in addition to the pump handle 42, a threaded pump shaft 92 extending from the pump handle 42, through a pump nut 94, and into a pump block 96, as will be discussed in greater detail below. The equalizer 20 further comprises a pair of hydraulic actuators 98*a,b* connected to the crossbar 38 proximate, respectively, to ends 88,86. Each hydraulic actuator 98*a,b* includes a cylinder 100*a,b*, respectively, that, in accordance with the preferred embodiment, extends from the top 78 of the crossbar 38 and defines a loading surface 102. Cylinder 100*b* includes a bleed-plug 103 disposed within a portal 150 (FIG. 7) that is defined by cylinder 100*b*. Similarly, cylinder 100*a* includes a bleed-plug (not seen) disposed within a portal 148 (FIG. 7) that is defined by cylinder 100*a*. Cylinder 100*a* is connected to the pump block 96 by tubing 104. One end of tubing 104 is connected to a portal 150 (FIG. 7) defined by cylinder 100*a* and the opposite end of tubing 104 is connected to a portal 170 (FIG. 8) defined by the pump block 96. Cylinder 100*b* is connected by tubing 106, T-fitting 108, and tubing 110 to the pump block 96. One end of tubing 106 is connected to a portal 148 (FIG. 7) defined by cylinder 100*b* and the opposite end of tubing 106 is connected to the T-fitting 108. One end of tubing 110 is connected to the T-fitting 108 and the opposite end of tubing 110 is connected to a portal 172 (FIG. 8) defined by the pump block 96. The T-fitting 108 is further connected to and extends upward from a portal 142 (FIG. 4) defined by the crossbar 38. An important aspect of the present invention is that the cylinders 100 are in fluid communication with each other by virtue of the tubing 104, 106, 110, hydraulic pump 44, and T-fitting 108 such that hydraulic pressure within cylinder 100*a* is maintained substantially equal to the hydraulic pressure within cylinder 100*b*, whereby an overall system hydraulic pressure is defined. Each of the hydraulic actuators 98*a,b* further includes, respectively, a piston 112*a,b* (FIGS. 3 and 7), and each piston 112*a,b* is movably housed within its respective cylinder 100*a,b* and includes a mounting surface 114 (FIGS. 3 and 7) that is exposed at the bottom 80 of the crossbar 38.

In accordance with the preferred embodiment of the present invention, the chassis 50 of truck 48*a* is connected to piston 112*a* (FIGS. 3 and 7), and the chassis of truck 48*b* is connected to piston 112*b*. The chassis 50 of each truck 48 defines a mounting surface 116 that is connected to the mounting surface 114 (FIGS. 3 and 7) of the respective piston 112. The connection is acceptably facilitated, for example, by bolts (not shown) that thread axially into the pistons 112. Each chassis 50 further defines a pair of flange surfaces 118*a,b* that face one another and slidingly engage the front 82 and rear 84, respectively, of the crossbar 38 when the trucks 48 are set into motion, as is discussed below. In accordance with the preferred embodiment, a pair of axles 120 span the base 122 of each chassis 50 in a manner that attaches rollers 52 thereto.

In accordance with the preferred embodiment of the present invention, the cover 40 includes a top panel 124 that defines two holes 125*a,b* therethrough. The cover further includes a front panel 126, rear panel 128, right end panel 130, and left end panel 132, each of which depends from the edges of the top panel 124. In accordance with the preferred embodiment of the present invention, when the cover 40 is properly fitted over the crossbar 38, the loading surface 102 of cylinder 100*a* fits into hole 125*a* and the loading surface 102 of the cylinder 100*b* fits into hole 125*a* such that the loading surfaces 102 and top panel 124 share a common plane. In accordance with the preferred embodiment of the present invention, the hydraulic actuators 98 and holes 125 are arranged such that the foot 76 (FIG. 1) of jackscrew 70*a* (FIG. 1) engages the loading surface 102 of cylinder 100*a* and the foot 76 of jackscrew 70*b* (FIG. 1) engages the loading surface 102 of cylinder 100*b*. Also, when the cover 40 is fitted over the crossbar 38, the panels 126,128,130,132 of the cover 40 partially cover the front 82, rear 84, and ends 86,88, respectively, of the crossbar 38. Certain alternate embodiments of the present invention do not include a cover 40.

Figure 3:
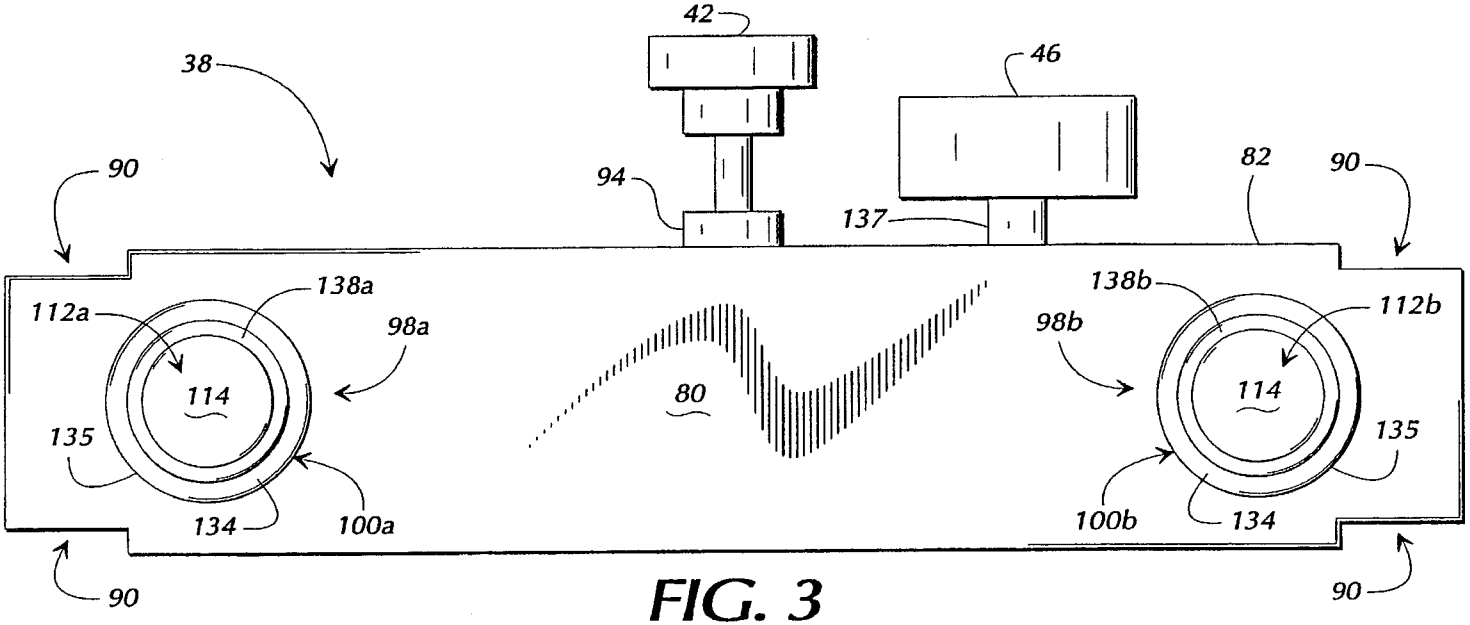
FIG. 3 is isolated bottom view of a portion of the equalizer assembly of FIG. 1, in accordance with the preferred embodiment of the present invention.

FIG. 3 is bottom, isolated view of the crossbar 38 as it is configured in FIG. 3. Each cylinder 100 extends through the crossbar 38 and terminates in the form of an annular lip 134 that flares outward from the base 135 of the cylinder 100 and engages the bottom 80 of the crossbar 38. The annular lips 134 function, along with other components discussed below, to secure the cylinders 100 to the crossbar 38. The cylinders 100 each define a bore 136 (FIG. 7) in which the respective piston 112 travels and from which the respective mounting surface 114 is accessible. As discussed above, each mounting surface 114 is secured to the mounting surface 116 of a truck 48. The travel of piston 112*a* is restricted by annular lock ring 138*a*, and the travel of piston 112*b* is restricted by annular lock ring 138*b*. As discussed in greater detail below annular lock ring 138*a* threads into the bore 136 (FIG. 7) of cylinder 100*a*, and piston 112*a* is capable of extending partially through lock ring 138*a*. Similarly, annular lock ring 138*b* threads into the bore 136 (FIG. 7) of cylinder 100*b*, and piston 112*b* is capable of extending partially through lock ring 138*b*. As discussed in greater detail below, the pressure gauge 46 includes a stem 137 extending from and connected to a portal 144 (FIG. 5) defined in the front 82 of the crossbar 38.

Figure 4:
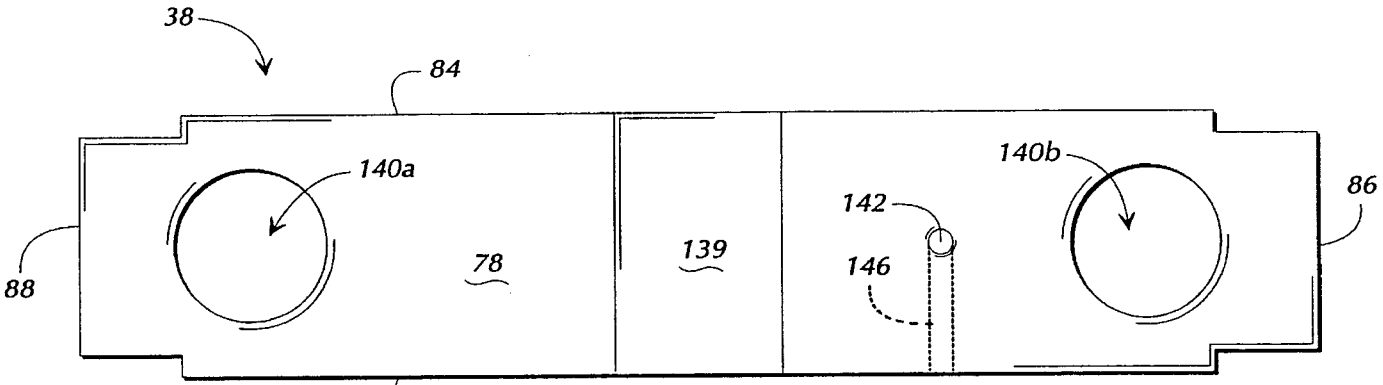
FIG. 4 is an isolated top view of a crossbar that is pan of the equalizer assembly of FIG. 1, in accordance with the preferred embodiment of the present invention.
Figure 5:
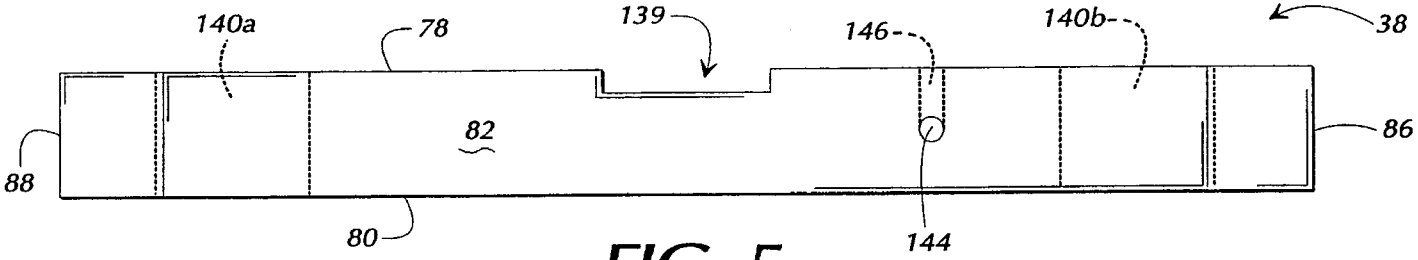
FIG. 5 is an isolated front view of the crossbar of FIG. 4, in accordance with the preferred embodiment of the present invention.

FIG. 4 is an isolated top view and FIG. 5 is an isolated front view of the crossbar 38, in accordance with the preferred embodiment of the present invention. Referring to FIGS. 4 and 5 simultaneously, the top 78 of the of the crossbar 38 defines a trough 139 in which the pump block 96 (FIG. 2) is secured. The crossbar 38 also defines bores 140*a,b* therethrough, from the top 78 to the bottom 80, in which the cylinders 100*a,b* (FIGS. 2, 3, 6, and 7), respectively, are secured. The crossbar further defines portals 142,144, and an internal passage 146 that provides fluid communication between the portals 142,144. In accordance with the preferred embodiment of the present invention, internal passage 146 is L-shaped. That is, in an end view (not shown) of the crossbar 38, internal passage 143 would be seen as having a first leg extending in a generally straight line from portal 142 toward the bottom 80 of the crossbar 38, and a second leg extending in a generally straight line from portal 144 toward the rear 84 of the crossbar 38 and joining the first leg. In accordance with the preferred embodiment of the present invention, the T-fitting 108 (FIG. 2) fits into portal 142 and is in fluid communication therethrough with internal passage 146, and the stem 137 (FIG. 3) of the pressure gauge 46 (FIGS. 1–3) fits into portal 144 such that the pressure gauge 46 is in fluid communication with internal passage 146.

Figure 7:
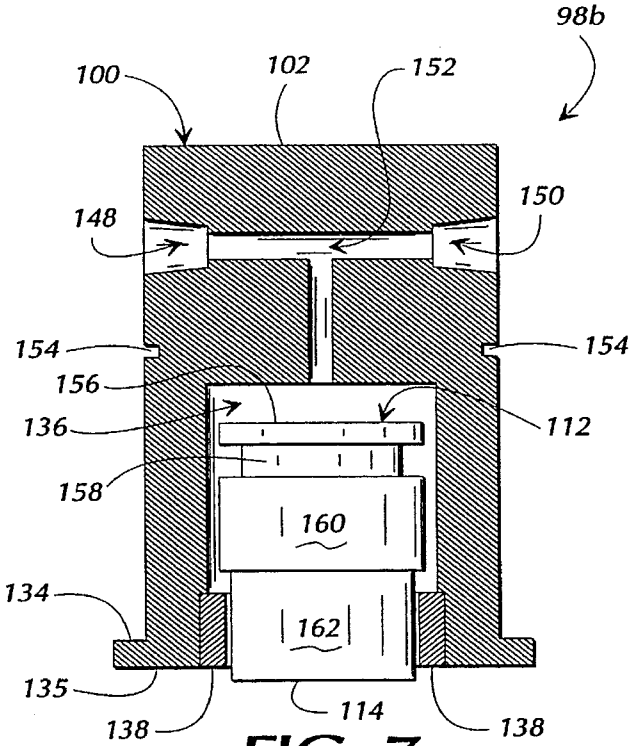
FIG. 7 is a partially cross-sectional view of the hydraulic actuator of FIG. 6 taken along line 7—7 of FIG. 6.
Figure 6:
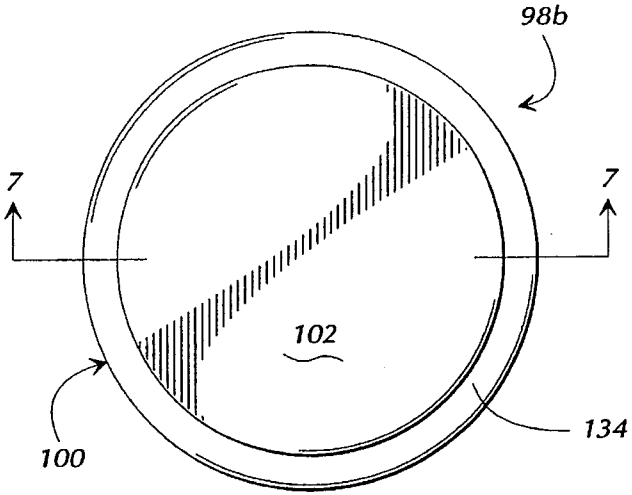
FIG. 6 is an isolated top view of a hydraulic actuator that is part of the equalizer assembly of FIG. 1, in accordance with the preferred embodiment of the present invention.

Referring back to FIG. 2, in accordance with the preferred embodiment of the present invention, hydraulic actuator 98*a* is substantially identical to hydraulic actuator 98*b*. Therefore, unless stated otherwise, the following description of a hydraulic actuator 98 is representative of both hydraulic actuator 98*a* and hydraulic actuator 98*b*. FIG. 6 is an isolated, top view of a representative hydraulic actuator 98, in accordance with the preferred embodiment of the present invention. In FIG. 6, only the cylinder 100, loading surface 102 (see also FIG. 2), and annular lip 134 (see also FIG. 3) of the hydraulic actuator 98 are seen. FIG. 7 is a partially cross-sectional view of the representative hydraulic actuator 98 taken along line 7—7 of FIG. 6. FIG. 7 shows the piston 112 within the bore 136 defined by the cylinder 100; the piston 112 is not cross-sectioned in FIG. 7 in an effort to clarify the view.

Referring in detail to FIG. 7, in accordance with the preferred embodiment of the present invention, the cylinder 100 defines portals 148,150 and a T-shaped internal passage 152 that provides for fluid communication between the portals 148,150 and the bore 136. The cylinder 100 further defines an annular groove 154 therearound. In accordance with the preferred embodiment of the present invention, the cylinder 100 is housed within a bore 140 (FIGS. 4 and 5) defined within the crossbar 38 (FIGS. 1–5). The annular lip 134 of the cylinder 100 abuts the bottom 80 (FIGS. 2, 3, 5) of the crossbar 38 and the annular groove 154 is proximate to the top 78 (FIG. 2, 4, and 5) of the crossbar 38. An annular retaining ring (not shown) is snapped into the annular groove 154 such that the annular retaining ring is partially within and partially extends from the annular groove 154 to engage the top 78 of the crossbar 38; whereby the annular retaining ring and annular lip 134 cooperate to securely affix the cylinder 100 to the crossbar 38. As discussed above, an annular lock ring 138 is threaded into the bore 136. More particularly, the annular lock ring 138 includes a threaded outer surface that threadedly engages the cylinder 100 such that the annular lock ring 138 actually threads into and is positioned within the bore 136 of the cylinder 100 in a manner that allows yet restricts movement of the piston 112, as discussed below.

Referring further to FIG. 7, the piston 112 includes a hydraulic engaging surface 156 opposite from the mounting surface 114 thereof. The piston 112 defines an annular groove 158 therearound in which resides a hydraulic sealing ring (e.g., an O-ring) (not shown). The hydraulic sealing ring defines the boundary between the portion of the bore 136 that is filled with hydraulic fluid and that portion of the bore 136 that is not filled with hydraulic fluid, as should be understood by those reasonably skilled in the art. The sealing ring that is housed, in part, within annular groove 158 allows for movement of the piston 112 within the bore and substantially precludes the flow of hydraulic fluid from the bore 136. The piston 112 further includes an annular midportion 160 and an annular base portion 162 that defines the mounting surface 114. In accordance with the preferred embodiment of the present invention, the annular midportion 160 defines a diameter that is sufficiently large to preclude travel of the annular midportion 160 through the passage defined through the annular lock ring 138, and the annular base portion 162 defines a diameter that is sufficiently small to allow for travel of the annular base portion 162 through the annular lock ring 138; therefore, the annular lock ring 138 functions to allow the piston 112 to "stroke" (e.g., move from a configuration in which a given portion of the annular base portion 162 is within the bore 136 to configurations in which the given portion of the annular base portion 162 extends from the base 135 of the cylinder 100). In accordance with the preferred embodiment of the present invention, a spring (not shown) is disposed within the bore 136. The spring within the bore 136 is constructed and arranged in a conventional manner to bias the piston 112 toward a configuration in which the piston 112 is retracted into the bore 136.

Figure 8:
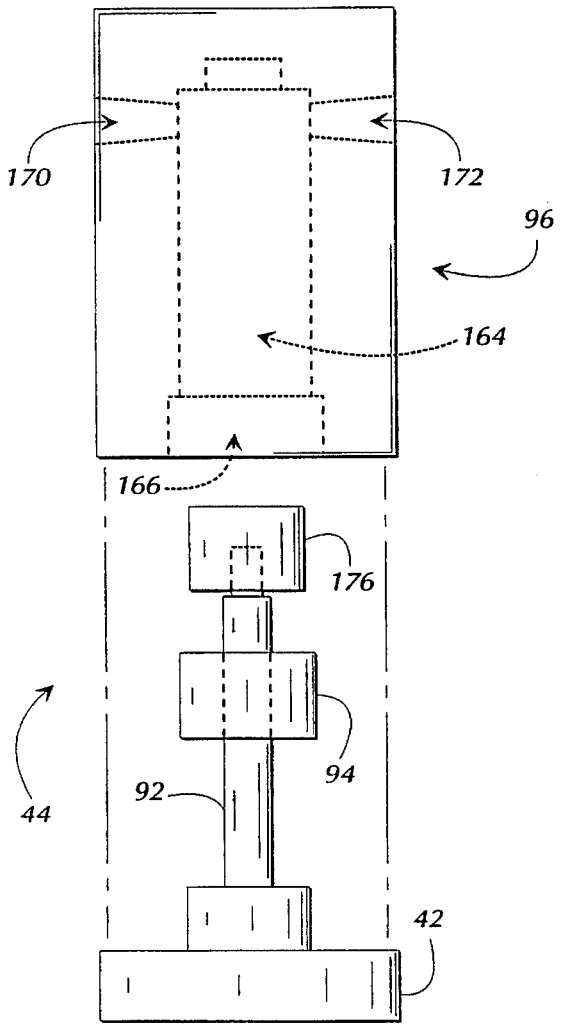
FIG. 8 is a top, partially exploded view of a hydraulic pump that is part of the equalizer assembly of FIG. 1, in accordance with the preferred embodiment of the present invention.

FIG. 8 is a top, partially exploded view of the hydraulic pump 44 (see also FIG. 2) in accordance with the preferred embodiment of the present invention. In accordance with the preferred embodiment, the pump block 96 defines an elongated, cylindrical, primary bore 164 and a nut receiving bore 166. The primary bore 164 is defined by smooth internal surfaces of the pump block 96. Portals 170,172 which are defined in opposite sides of the pump block 96 are in fluid communication with the primary bore 164. In accordance with the preferred embodiment of the present invention, the pump nut 94 (see also FIG. 2) is secured in the nut receiving bore 166 and extends partially from the nut receiving bore 166. In accordance with the preferred embodiment, the pump nut 94 defines a threaded internal bore and the pump shaft 92 (see also FIG. 2) includes a threaded surface. The pump shaft 92 extends through and threadedly engages the pump nut 94 such that as the pump handle 42 is rotated the pump shaft 92 threads through the pump nut 94 to move the pump shaft 92 into and out of the primary bore 164. The hydraulic pump 44 further includes a cylindrical pressure cup 176 connected to the end of the pump shaft 92 opposite from the pump handle 42. The pressure cup 176 functions to define the boundary between the portion of the primary bore 164 that is filled with hydraulic fluid and that portion of the primary bore 164 that is not filled with hydraulic fluid, as should be understood by those reasonably skilled in the art. The pressure cup 176 moves within the primary bore 164 when the pump handle 42 is turned to thread the pump shaft 92 through the pump nut 94. The hydraulic pump 44 is constructed such that movement of the pressure cup 176 toward the portals 170,172 increases hydraulic pressure within the primary bore 164 and movement of the pressure cup 176 toward the nut receiving bore 166 decreases hydraulic pressure within the primary bore 164.

Figure 9:
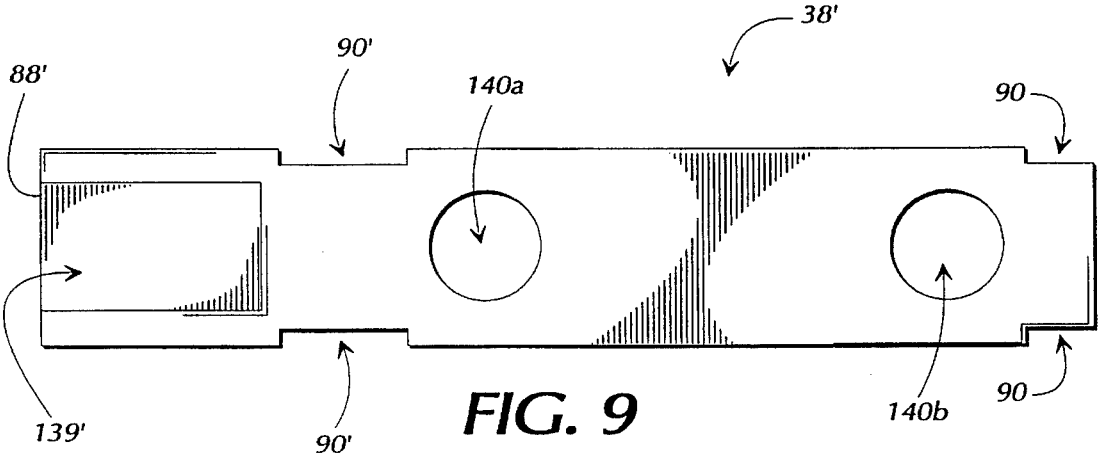
FIG. 9 is a top view of a crossbar in accordance with a first alternate embodiment of the present invention.

Referring back to FIG. 1, in accordance with a first alternate embodiment of the present invention, the hydraulic pump 44 (FIGS. 2 and 8) is mounted such that it will be in a position characterized as being outside of the press frame 24 and proximate to one of the sides 54,56 of the press frame 24. It is believed that this positioning will render the hydraulic pump 44 more accessible to a user. Referring to FIG. 9, which is a top view of a crossbar 38' in accordance with the first alternate embodiment of the present invention, the crossbar 38' defines the trough 139', into which the hydraulic pump 44 is secured, proximate to the leer end 88' of the crossbar 38'. The position of the hydraulic pump 44 relative to the sides 54,56 of the press frame 24 can be inferred by reference to the indentations 90 and indentations 90' which accommodate the upright members that are part of the right side 54 and left side 56, respectively, of the press frame 24.

Figure 10:
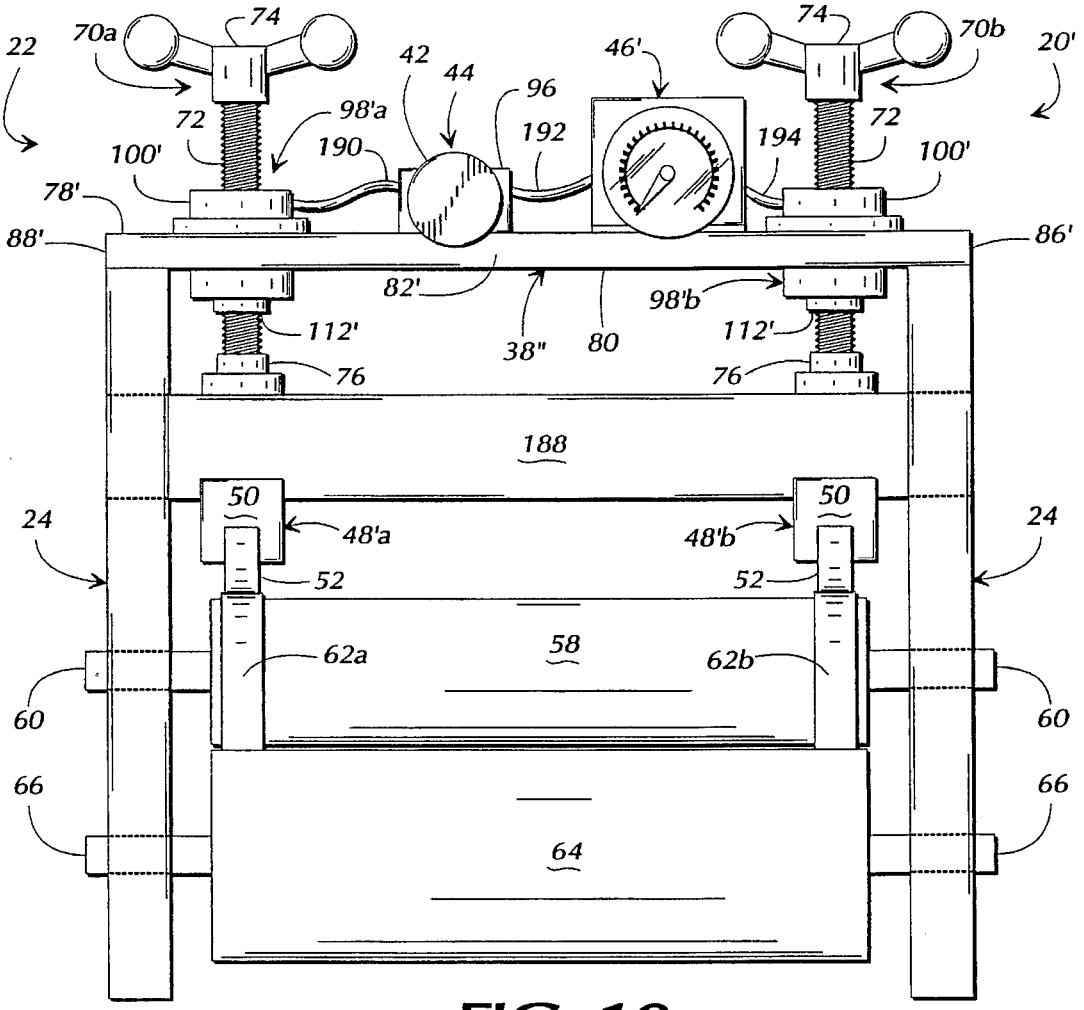
FIG. 10 is a front elevational view of an alternate equalizer assembly mounted to the die cutting station of a press frame, in accordance with a second alternate embodiment of the present invention.

FIG. 10 is a front elevational view of an equalizer 20' mounted to the die cutting station 22 of a press frame 24, in accordance with a second alternate embodiment of the present invention. As discussed in greater detail below, when the equalizer 20' is in use it is, in accordance with the second alternate embodiment of the present invention, connected to the press frame 24 of a conventional die cutting station 22 and takes the place of a conventional bridge bar 68 (FIG. 1). The equalizer 20' is preferably shaped and sized to allow the equalizer 20' to be installed in and removed from the die cutting station 22 of a press frame 24 in substantially the same manner that a conventional bridge bar 68 is installed in and removed from the cutting station 22. In accordance with the second alternate embodiment of the present invention, when the equalizer 20' is installed within the cutting station 22, the equalizer 20' is disposed above a conventional pressure bar 188 from which depend trucks 48'*a,b* that include chassis 50 and rollers 52; the pressure bar 188 is disposed above a conventional rotary cutting die 58 that includes annular bearers 62*a,b* and shafts 60 and defines cutting elements (not shown) thereon; and the rotary cutting die 58 is disposed above a conventional rotary anvil 64 that includes shafts 66. In accordance with the second alternate embodiment, the equalizer 20' interacts with a pair of jackscrews 70*a,b,* each of which includes an elongated threaded shank 72 extending between a handle 74 and foot 76.

Figure 11:
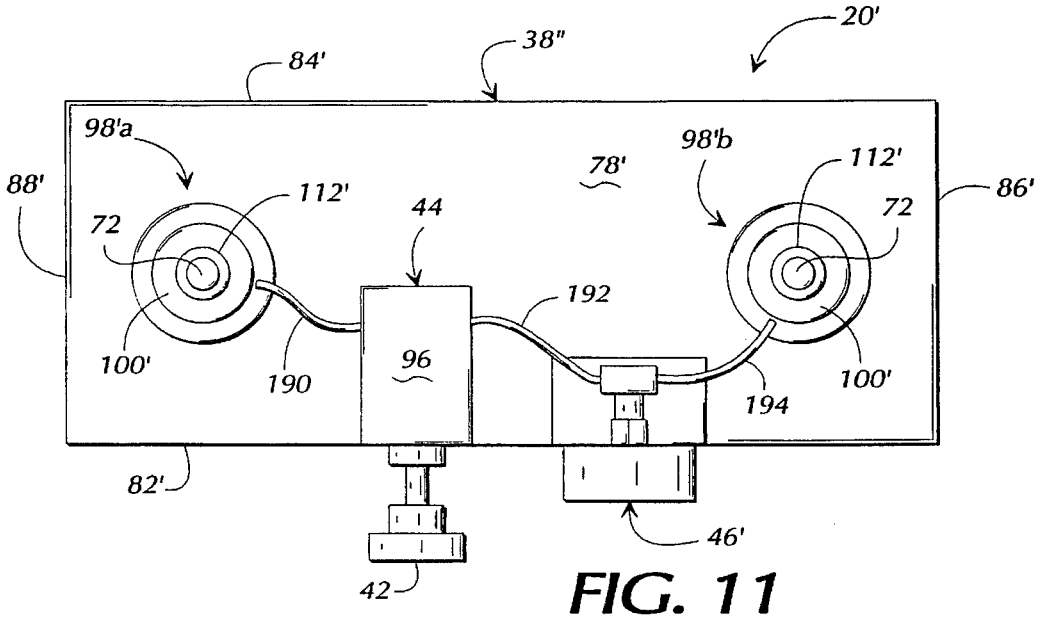
FIG. 11 is a top view of the equalizer assembly of FIG. 10.

FIG. 11 is a top view of the equalizer 20' mounted to the die cutting station 22 (FIG. 10) of the press frame 24 (FIG. 10). The handles 74 (FIG. 10) of the jackscrews 70 (FIG. 10) are cutaway in FIG. 11 to clarify the view. Referring to both FIGS. 10 and 11, the equalizer 20' comprises an alternate crossbar 38" that defines a top 78' front 82', rear 84', right end 86', and left end 88'. The crossbar 38" further defines a pair of bores (not seen, but see bores 140*a,b* in FIGS. 4 and 5 for example) in which a pair of hydraulic actuators 98'*a,b* are secured. In accordance with the second alternate embodiment of the present invention, each hydraulic actuator 98' preferably includes a cylinder 100' that extends through the crossbar 38" and a piston 112' movable within the cylinder 100'. Each piston 112 preferably defines a threaded bore (not seen) therethrough that is accessible proximate to the top 78' and bottom 80' of the crossbar 38". In accordance with the second alternate embodiment of the present invention, the shank 72 of jackscrew 70'*a* (FIG. 10) extends through the bore of and threadedly engages the piston 112' of hydraulic actuator 98'*a*, and the shank 72 of jackscrew 70'*b* (FIG. 10) extends through the bore of and threadedly engages the piston 112' of hydraulic actuator 98'*b*. The hydraulic actuators 98' are preferably configured and arranged such that the foot 76 of a jackscrew 70' is capable of being forced against or retrieved from the pressure bar 188 by rotating the handle 74 of the jackscrew 70'. Likewise, the hydraulic actuators 98' are preferably configured and arranged such that when the feet 76 are engaging the pressure bar 188 and the hydraulic pressure within the cylinders 100' is increased and decreased, respectively, the force applied to the pressure bar 188 by the feet 76 is increased and decreased, respectively. Moreover, the hydraulic actuators 98' are preferably substantially identical such that when the cylinder 100' of hydraulic actuator 98'*a* is placed in proper fluid communication with the cylinder 100' of hydraulic actuator 98'*b*, as discussed in greater detail below, the force applied by the foot 76 of jackscrew 70*a'* on the pressure bar 188 is substantially equal to the force applied by the foot 76 of jackscrew 70*b'* on the pressure bar 188. In accordance with the second o alternate embodiment of the present invention, suitable hydraulic actuators 98' are, for example, ENERPAC hollow Cylinders which are available from the Enerpac Group, Applied Power Inc., of Butler, Wis.

In accordance with the second alternate embodiment of the present invention, the equalizer 20' further includes the hydraulic pump 44 (see also FIGS. 2 and 8) and a pressure gauge 46' mounted to the top 78' of the crossbar 38". A tube 190 extends from portal 170 (FIG. 8) of the hydraulic pump 44 to the cylinder 100' of hydraulic actuator 98'*a* and provides fluid communication therebetween. A tube 192 extends from portal 172 (FIG. 8) of the hydraulic pump 44 to the pressure gauge 46' and provides fluid communication therebetween. A tube 194 extends between the pressure gauge 46' and the cylinder 100' of hydraulic actuator 98'*b* and provides fluid communication therebetween. An important aspect of the present invention is that the cylinders 100' are in fluid communication by virtue of the tubes 190,192, 194, hydraulic pump 96, and pressure gauge 46' such that the hydraulic pressure within the cylinder 100' of hydraulic actuator 98'*a* is maintained substantially equal the hydraulic pressure within the cylinder 100' of hydraulic actuator 98'*b*, whereby an overall system hydraulic pressure is defined.

OPERATION

Referring back to FIGS. 1 and 10, in accordance with the preferred and first and second alternate embodiments of the present invention, the equalizers 20 and 20' integrate into the die cutting station 22 of a press frame 24 and function such that the die cutting station 22 is capable of being operated in a manner similar to that in which a die cutting station including only conventional components operates. More specifically, and with reference to FIG. 1, by rotating the jackscrews 70 in a manner that causes them to engage and apply force on the top 30 of the equalizer 20, the equalizer 20 applies force through the trucks 48, which act as linkages, to the rotary cutting die 58 by way of the annular bearers 62, whereby pressure is applied between the rotary cutting die 58 and the rotary anvil 64. An importantly inventive aspect of the present invention is that the equalizer 20 is so constructed and arranged that the force applied through truck 48*a* is automatically maintained equal to the force applied through truck 48*b*. This equalization is due to the fluid communication between and equivalent sizing of the hydraulic actuators 98 (FIGS. 2, 6 and 7). For example and within certain limits, if both jackscrews 70*a,b* are engaging the equalizer 20 and only one jackscrew 70*a* is screwed to increase the pressure applied thereby onto the equalizer 20, the jackscrew 70*a* merely has the effect of increasing the system hydraulic pressure, and the hydraulic actuators 98*a,b* each respond identically to the system hydraulic pressure such that hydraulic actuator 98*a* generates a "first" force that is imparted, by way of truck 48*a*, onto the rotary cutting die 58, and hydraulic actuator 98*b* generates a "second" force that is imparted, by way of truck 48*b*, onto the rotary cutting die 58. The first force and the second force are equal, whereby uniform pressure is automatically applied between the rotary cutting die 58 and the rotary anvil 64. Similarly, for example, if one end of the rotary cutting die were to expand more than the other during usage, the expanded end would merely have the effect of increasing the system hydraulic pressure, whereby uniform pressure would be automatically maintained, although slightly increased, between the rotary cutting die 58 and the rotary anvil 64. Of course the system hydraulic pressure can also be increased by manually operating the hydraulic pump 44 (FIG. 2), and the system hydraulic pressure is indicated by the pressure gauge 46 so that a user can correlate the pressure that is being applied between the rotary cutting die 58 and the rotary anvil 64. Thus, in accordance with the preferred embodiment of the present invention, system hydraulic pressure is capable of being controlled from three different sources: jackscrew 70*a*, jackscrew 70*b*, or the hydraulic pump 44. In accordance with the preferred embodiment of the present invention, the hydraulic pump 44 is constructed and arranged to provide more sensitive control over the system hydraulic pressure than is provided by operation of the jackscrews 70. One acceptable example of an equalizer 20 is one in which the hydraulic pump 44 is configured and arranged to allow a user to easily create a system hydraulic pressure of approximately 2000 psig., and the engaging surface 156 (FIG. 7) of each piston 112 (FIGS. 3 and 7) is approximately one square inch, whereby each hydraulic actuator 98 is capable of generating a force of 2000 pounds.

Referring to FIGS. 10 and 11, the equalizer 20' of the second alternate embodiment functions in a manner similar to the equalizer 20 of the first preferred embodiment to automatically equalize the pressure applied between a rotary cutting die 58 and a rotary anvil, as should be understood by those reasonably skilled in light of this disclosure.

Whereas this invention has been described in detail with particular reference to preferred embodiments and alternate embodiments thereof, it will be understood that variations and modifications can be effected within the spirit and scope of the invention, as described herein before and as defined in the appended claims.

I claim:

1. In a press assembly comprising a frame; a rotary anvil connected to the frame and including a first end and a second end; a rotary cutting die disposed above the rotary anvil, connected to the frame, and including a first end adjacent to the first end of the rotary anvil and a second end adjacent to the second end of the rotary anvil; a pressure bar disposed above the rotary cutting die and including a first end proximate to and for interacting with the first end of the rotary cutting die, and a second end proximate to and for interacting with the second end of the rotary cutting die; a bridge bar disposed above the pressure bar and connected to the frame; and a pair of jackscrews movably connected to the bridge bar, wherein the press assembly is so constructed and arranged that upon proper operation, respectively, of a first jackscrew and a second jackscrew of the pair of jackscrews, the first jackscrew functions to apply a force to the pressure bar proximate to the first end of the pressure bar and the second jackscrew functions to apply a force to the pressure bar proximate to the second end of the pressure bar; and wherein the pressure bar translates the forces applied thereto to the rotary cutting die in the form of a first force applied proximate to the first end of the rotary cutting die and a second force applied proximate to the second end of the rotary cutting die so that pressure is applied between the rotary cutting die and the rotary anvil, wherein an improvement thereto comprises:

a first hydraulic actuator constructed and arranged to interact with the first jackscrew to develop a first hydraulic pressure that corresponds to the first force, wherein said first hydraulic actuator includes a first cylinder connected to the bridge bar and a first piston movably connected to said first cylinder, wherein said first hydraulic actuator is so constructed and arranged to, in response to increases in the force applied by the first jackscrew, cause said first piston to move relative to said first cylinder such that said first hydraulic pressure increases, wherein said first hydraulic actuator is so constructed and arranged to, in response to decreases in the force applied by the first jackscrew, allow said first piston to move relative to said first cylinder so that said first hydraulic pressure decreases, and wherein said first piston defines a first bore therethrough and the first jackscrew extends through said first bore and threadedly engages said first piston in a manner that facilitates movement of the first jackscrew relative to said first piston, a second hydraulic actuator constructed and arranged to interact with the second jackscrew to develop a second hydraulic pressure that corresponds to the second force, wherein said second hydraulic actuator includes a second cylinder connected to the bridge bar and a second piston movably connected to said second cylinder, wherein said second hydraulic actuator is so constructed and arranged to, in response to increases in the force applied by the second jackscrew, cause said second piston to move relative to said second cylinder such that said second hydraulic pressure increases, wherein said second hydraulic actuator is so constructed and arranged to, in response to decreases in the force applied by the second jackscrew, allow said second piston to move relative to said second cylinder such that said second hydraulic pressure decreases, and wherein said second piston defines a second bore therethrough and the second jackscrew extends through said second bore and threadedly engages said second piston in a manner that facilitates movement of the second jackscrew relative to said second piston, wherein said first hydraulic actuator and said second hydraulic actuator are in fluid communication so that said first hydraulic pressure and said second hydraulic pressure are equalized, whereby said first hydraulic pressure equals said second hydraulic pressure to define a system hydraulic pressure, and wherein said first hydraulic actuator and said second hydraulic actuator are so constructed and arranged that when said first hydraulic pressure equals said second hydraulic pressure, the first force equals the second force, whereby the first force and the second force are automatically equalized, whereby the pressure between the rotary cutting die and the rotary anvil proximate to the first ends thereof is substantially similar to the pressure between the rotary cutting die and the rotary anvil proximate to the second ends thereof, whereby the pressure distribution between the rotary cutting die and the rotary anvil is substantially uniform.

2. An apparatus for applying force, by virtue of a hydraulic pressure, to a first press roller that is adjacent to a second press roller in a press, said apparatus comprising:

a press frame:

the second press roller connected to said frame, and defining an anvil axis;

the first press roller disposed above the second press roller and movably connected to said press frame, wherein the first press roller includes a first end and a second end, and wherein the first press roller defines a die axis that is substantially parallel to said anvil axis and that extends between said first end and said second end of the first press roller;

a bar member movably connected to said press frame above the first press roller, wherein said bar member includes a bar top, and a bar bottom, and wherein said bar member defines, a first bore therethrough, from said bar top to said bar bottom, and a second bore therethrough, from said bar top to said bar bottom;

a hydraulic pump, said hydraulic pump creating at least a portion of the hydraulic pressure;

a first cylinder actuator in fluid communication with said hydraulic pump and including a first cylinder disposed within said first bore and connected to said bar member, and a first piston housed within and capable of extending from and retracting into said first cylinder and thereby defining a first direction of travel that defines a line that intersects the first press roller, wherein said first piston includes a first mounting surface that is proximate to said bar bottom and is capable of extending from said first bore at said bar bottom, and wherein the hydraulic pressure within said first cylinder results in a first force on said first piston;

a second cylinder actuator in fluid communication with said hydraulic pump and including a second cylinder disposed within said second bore and connected to said bar member, and a second piston housed within and capable of extending from and retracting into said second cylinder and thereby defining a second direction of travel that defines a line that intersects the first press roller, wherein said second piston includes a second mounting surface that is proximate to said bar bottom and is capable of extending from said second bore at said bar bottom, and wherein the hydraulic pressure within said second cylinder results in a second force on said second piston;

a first linkage means for translating said first force from said first piston to the first press roller, wherein said first linkage means is attached to said first mounting surface, and wherein said first linkage means is disposed between said first piston and the first press roller and contacts the first press roller at a position closer to said first end than said second end of the first press roller;

a second linkage means for translating said second force from said second piston to the first press roller, wherein said second linkage means is attached to said second mounting surface, and wherein said second linkage means is disposed between said second piston and the first press roller and contacts the first press roller at a position closer to said second end than said first end of the first press roller;

a bridge means for selectively restricting movement of said bar member, wherein said first cylinder actuator, said second cylinder actuator, and said hydraulic pump are in fluid communication, and are constructed and arranged such that when said hydraulic pump is operated to increase the hydraulic pressure, said first force and said second force result and are transferred by way of said first linkage and said second linkage, respectively, to the first press roller, whereby said first force and said second force are applied to the first press roller.

* * * * *